US007609991B2

(12) United States Patent
Koshida

(10) Patent No.: US 7,609,991 B2
(45) Date of Patent: Oct. 27, 2009

(54) IMAGE HEATING APPARATUS WITH AN AXIAL FLOW FAN FOR COOLING A PORTION OF A HEATING ROTATABLE MEMBER

(75) Inventor: Kohei Koshida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/846,687

(22) Filed: Aug. 29, 2007

(65) Prior Publication Data

US 2008/0056755 A1 Mar. 6, 2008

(30) Foreign Application Priority Data

Aug. 29, 2006 (JP) ..... 2006-232080

(51) Int. Cl.
*G03G 21/20* (2006.01)

(52) U.S. Cl. ..... 399/92; 399/69; 399/67; 399/334; 399/94

(58) Field of Classification Search ..... 399/69, 399/92, 67, 334, 94
See application file for complete search history.

(56) References Cited

U.S. PATENT DOCUMENTS

| | | | | |
|---|---|---|---|---|
| 5,148,226 | A | 9/1992 | Setoriyama et al. | 355/290 |
| 5,210,579 | A | 5/1993 | Setoriyama et al. | 355/285 |
| 5,525,775 | A | 6/1996 | Setoriyama et al. | 219/216 |
| 5,787,321 | A * | 7/1998 | Nishikawa et al. | 399/69 |
| 2006/0072933 | A1 * | 4/2006 | Miyamoto et al. | 399/92 |

FOREIGN PATENT DOCUMENTS

| | | | |
|---|---|---|---|
| JP | 4-44075 | | 2/1992 |
| JP | 4-44076 | | 2/1992 |
| JP | 4-44077 | | 2/1992 |
| JP | 4-44078 | | 2/1992 |
| JP | 4-44079 | | 2/1992 |
| JP | 4-44080 | | 2/1992 |
| JP | 4-44081 | | 2/1992 |
| JP | 4-44082 | | 2/1992 |
| JP | 4-44083 | | 2/1992 |
| JP | 4-51179 | | 2/1992 |
| JP | 4-204980 | | 7/1992 |
| JP | 4-204981 | | 7/1992 |
| JP | 4-204982 | | 7/1992 |
| JP | 4-204983 | | 7/1992 |
| JP | 4-204984 | | 7/1992 |
| JP | 11194569 | A * | 7/1999 |
| JP | 2001013855 | A * | 1/2001 |
| JP | 2003-076209 | | 3/2003 |

* cited by examiner

*Primary Examiner*—David M Gray
*Assistant Examiner*—G. M. Hyder
(74) *Attorney, Agent, or Firm*—Fitzpatrick, Cella, Harper & Scinto

(57) ABSTRACT

An image heating apparatus includes a heating rotatable member for heating a toner image on a recording material at a nip; an axial flow fan for cooling the heating rotatable member at a longitudinal end portion thereof; wherein an axis of the axial flow fan extends from its outlet disposed adjacent the longitudinal end portion inclinedly toward a longitudinally central portion of the heating rotatable member.

5 Claims, 11 Drawing Sheets

IMAGE HEATING APPARATUS WITH AN AXIAL FLOW FAN FOR COOLING A PORTION OF A HEATING ROTATABLE MEMBER

FIELD OF THE INVENTION AND RELATED ART

The present invention relates to an image heating apparatus employed by an electrophotographic or electrostatic image forming apparatus, such as a copying machine, a printer, a facsimile machine, etc., in order to heat the image on recording medium.

As the examples of an image heating apparatus, a fixing apparatus for fixing an unfixed image on recording medium, a glossiness increasing apparatus for heating the fixed image on recording medium in glossiness to increase the fixed image in glossiness, etc., may be listed.

When an electrophotographic image forming apparatus is used to form an image, a toner image, which is in the unfixed state, is formed on recording medium (recording paper) by an image forming means, and then, the unfixed toner image is fixed to the recording medium.

There have been proposed various fixing means. Among these fixing means, a fixing apparatus which fixes an unfixed toner image by the application of heat and pressure to the unfixed toner image is mostly commonly in use. A fixing apparatus of this type has a heat applying rotatable member (fixation roller, fixation belt, etc.), and a pressure applying rotatable member (pressure roller, pressure belt, etc.). The heat applying rotatable member is heated by a heating means. The pressure applying rotatable member is kept in contact with the heat applying member, forming thereby a fixation nip. As for the operation of a fixing apparatus, the two rollers are rotated together, and a sheet of recording medium, on which an unfixed toner image is borne, is introduced into the fixation nip between the two rotatable members, and is conveyed through the fixation nip, while remaining pinched by the two rotatable members. While the recording medium is conveyed through the fixation nip, the toner image on the recording medium is fixed to the recording medium by the heat from the heat applying rotatable member, and the nip pressure.

A fixing apparatus of the above described type is designed to accommodate various recording media, that is, recording mediums different in width (dimension in terms of the direction parallel to rotational axes of rotatable members). Thus, when a substantially number of small sheets of recording medium, that is, sheets of recording medium narrower than the widest sheet of recording medium conveyable through the fixing apparatus, are continuously conveyed through the fixing apparatus, the portions of the heat applying rotatable member, which are outside the path of the small sheet of recording medium, tend to increase in surface temperature, for the following reason. That is, when a small sheet of recording medium is conveyed through the fixing apparatus, the portions of the heat applying rotatable member, which are outside the path of the recording medium is not robbed of heat. Thus, as a substantial number of small sheets of recording medium are continuously conveyed through the fixing apparatus, heat tends to accumulate in the portions of the heat applying rotatable member, which are outside the path of the small sheet of recording medium.

The above described phenomenon is referred to as "peripheral temperature increase" or "out-of-sheet-path temperature increase" of a fixing apparatus. If this "peripheral temperature increase" exceeds a certain level, problems such as the "hot offset", and/or thermal deterioration of the structural components of the fixing apparatus, is likely to occur.

One of the countermeasures for the above described problems is disclosed in Japanese Laid-open Patent Applications H04-51179, 2003-076209, for example. According to these applications, the fixing apparatuses are structured to air cool the out-of-sheet-path portions of the fixing apparatus, in order to prevent the peripheral temperature increase, that is, the phenomenon which occurs when a substantial number of small sheets of recording medium are conveyed through a fixing apparatus.

In the case of the prior technologies, however, the cooling fan(s) and ducts for guiding the cooling draft, are aimed virtually perpendicular to the rotational axis of the heat applying rotatable member. Therefore, it is possible that the following problem will occur, which will be described next with referent to FIG. 11.

Referring to FIG. 11, designated by a referential number 101 is a fixation roller. Designated by a referential number 102 is an elastic pressure applying roller, which is a pressure applying rotatable member (which hereafter will be referred to as pressure roller). The pressure roller 102 is kept pressed upon the fixation roller 101, forming a fixation nip N. The fixation roller 101 is heated by a heat source disposed within the hollow of the fixation roller 101, so that its surface temperature remains at a preset fixation temperature. The pair of rollers 101 and 102 are rotated together, and a sheet of recording medium, on which an unfixed toner image is borne, is introduced into, and conveyed through, the fixation nip N between the rotating two rollers 101 and 102. As the recording medium is conveyed through the fixation nip N while remaining pinched by the two rollers, the unfixed toner image on the recording medium is fixed to the surface of the recording medium by the heat from the fixation roller 101 and the nip pressure. In the case of the fixing apparatus in this embodiment, recording medium is introduced into, and conveyed through, the fixing apparatus so that, in terms of the direction perpendicular to the recording medium conveyance direction, the center of the recording medium coincides with the centerline of the recording medium passage of the fixing apparatus. Designated by alphanumeric referential symbols 103L and 103R are the left and right cooling means which cool the out-of-sheet-path portions of the fixation roller 101, by sending cooling draft to the out-of-sheet-path portions. The left and right cooling means 103L and 103R are provided with ducts 104L and 104R, and cooling fans 105L and 105R, respectively, which send cooling draft into these ducts 104L and 104R, respectively. The ducts 104L and 104R are provided with an air outlet a aimed toward the corresponding lengthwise end portion of the fixation roller 101. The cooling means 103L and 103R are also provided with movable shutter 106L and 106R, respectively, which are in the form of a plate. The shutter 106 is used to control the width (in the direction parallel to rotational axis of fixation roller) of the air outlet a of the duct 104. The cooling fans 105L and 105R, and the duct 104L and 10R, are aimed roughly perpendicular to the axial line O-O of the fixation roller 101.

As for the recording medium width in terms of the direction perpendicular to the direction in which recording medium is conveyed through the fixing apparatus, widest and narrowest sheets of recording paper, which can be conveyed through the fixing apparatus will be referred to as a large recording paper and a small recording paper, respectively, hereafter. A sheet of recording paper, the width of which is between those of large and small recording papers, will be referred to as a medium recording paper.

FIG. 11(*a*) is a schematic vertical sectional view of the fixing apparatus through which a small recording paper is being conveyed. Designated by a referential letter Q is the range which corresponds to the path of a small recording paper, and designated by a referential R are the left and right out-of-sheet-path ranges, which occur as a small recording paper is conveyed through the fixing apparatus. The air outlets a of the left and right ducts 104L and 104R directly face the left and right lengthwise end portions of the fixation roller 101, which correspond to the out-of-sheet-path range. Further, the air outlets a of the left and right ducts 104L and 104R are adjusted in width so that their width matches that of the left and right out-of-sheet-path portions of the fixation roller 101. The left and right shutters 106L and 106R are in their positions in which they keep wide open the air outlets a of the left and right ducts 104L and 104R. Therefore, as a small recording paper is conveyed through the fixing apparatus, the left and right out-of-sheet-path portions R and R of the fixation roller 101 are cooled by the cooling draft blown out of the wide open air outlets a of the left and right ducts 104L and 104R, being thereby prevented from excessively increasing in temperature. Thus, even if a substantial number of small recording papers are continuously conveyed through the fixing apparatus, the out-of-sheet-path portions of the fixation roller 101 are prevented from increasing in temperature.

FIG. 11(*b*) is a schematic vertical sectional view of the fixing apparatus through which a medium recording paper is being conveyed. Designated by a referential letter Q is the range which corresponds to the path of a medium recording paper, and designated by a referential R are the left and right out-of-sheet-path ranges, which occur as a medium recording paper is conveyed through the fixing apparatus. When a medium recording paper is used as recording medium, the left and right shutters 106L and 106R are moved to their positions preset to match the width of the air outlets a of the left and right ducts 104L and 104R to the width of a medium recording paper. Therefore, as a medium recording paper is conveyed through the fixing apparatus, the left and right out-of-sheet-path portions R and R of the fixation roller 101 are cooled by the cooling draft blown out of the air outlets a of the left and right ducts 104L and 104R, which match in width the left and right out-of-sheet-path portions R and R. Therefore, the left and right out-of-sheet-path portions R and R of the fixation roller 101 are prevented from excessively increasing in temperature. Thus, even if a substantial number of medium recording papers are continuously conveyed through the fixing apparatus, the out-of-sheet-path portions of the fixation roller 101 are prevented from excessively increasing in temperature.

FIG. 11(*c*) is a schematic vertical sectional view of the fixing apparatus through which a large recording paper is being conveyed. In this case, there is no out-of-sheet-path range, and therefore, the problem that the out-of-sheet-path portions become excessive in temperature does not occur. Thus, the left and right shutters 106L and 106R are kept in their positions preset to keep the air outlets a of the left and right ducts 104L and 104R completely shut. Therefore, the fixation roller 101 is not subjected to the cooling draft.

However, a conventional setup, such as the above described one, for cooling the out-of-sheet-path portions of a fixation roller has the following problems. That is, as cooling draft is blown upon the out-of-sheet-path portions R of the fixation roller 101, it partially diverts into the sheet path range Q as indicated by a flow line X in FIG. 11(*a*). Thus, the portions of the fixation roller 101, which correspond to the edge portions of the sheet path, are reduced in temperature. A problem similar to this problem is also likely to occur when the fixing apparatus is in the state shown in FIG. 11(*b*).

In other words, the conventional setup for cooling the out-of-sheet-path portions of a fixation roller is problematic in that the portion of the fixation roller, which is in the sheet path range, is reduced in temperature by the diversion of the cooling draft, which sometimes results in the formation of an abnormal image, that is, an image which is abnormal in that it is inferior in fixation across its edge portions

SUMMARY OF THE INVENTION

Thus, the primary object of the present invention is to provide an image heating apparatus which does not suffer from the problem that an image is unsatisfactorily fixed because the cooling draft generated by a fan diverts into the sheet path range of the fixing apparatus.

According to an aspect of the present invention, there is provided an image heating apparatus comprising a heating rotatable member for heating a toner image on a recording material at a nip; an axial flow fan for cooling said heating rotatable member at a longitudinal end portion thereof; wherein an axis of said axial flow fan extends from its outlet disposed adjacent the longitudinal end portion inclinedly toward a longitudinally central portion of said heating rotatable member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings. However, the preferred embodiments are not intended to limit the present invention in scope.

Embodiment 1

(1) Image Forming Portion

Figure 10:
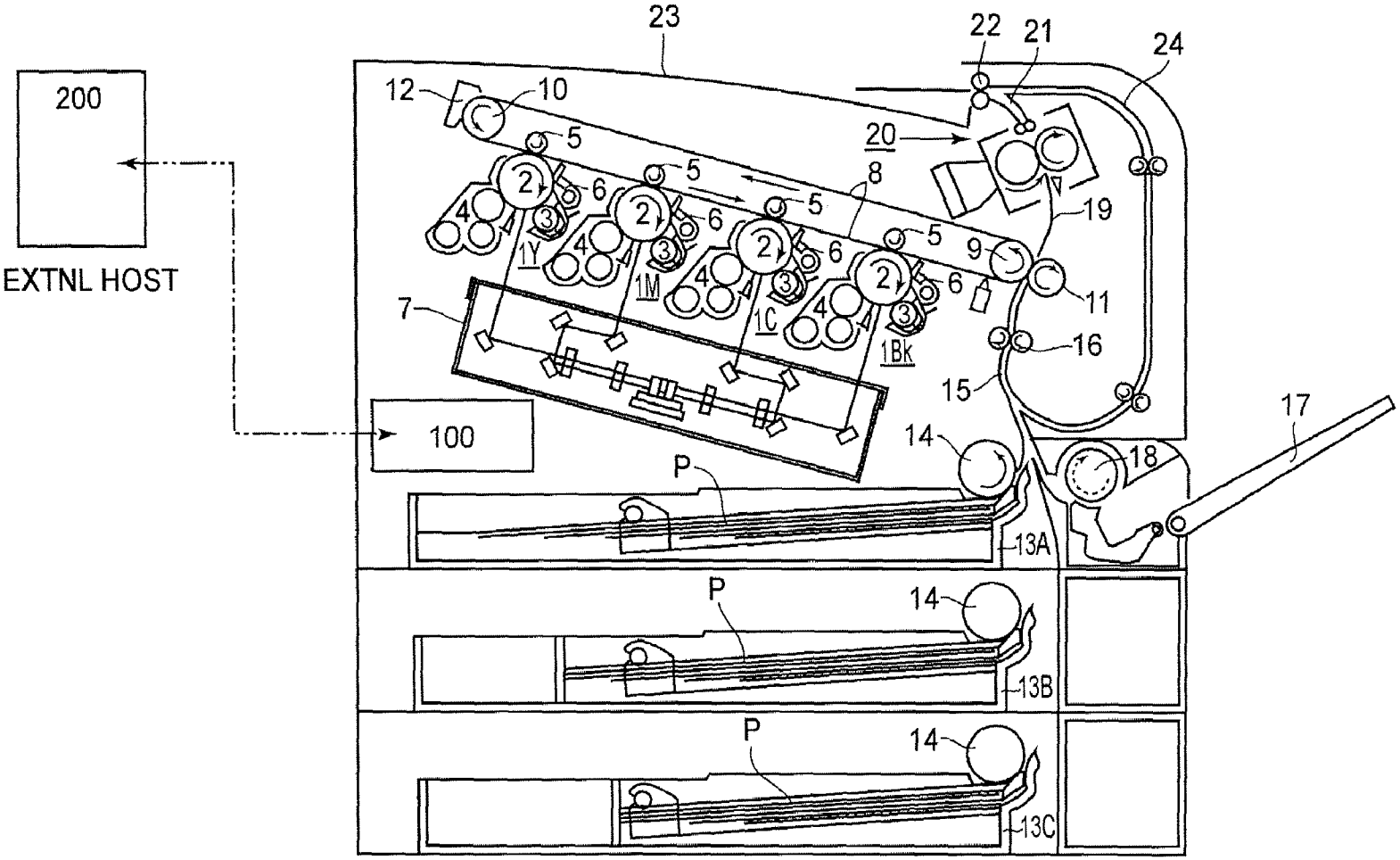
FIG. 10 is a vertical cross-sectional view of the image forming apparatus in the preferred embodiment of the present invention.
Figure 11:
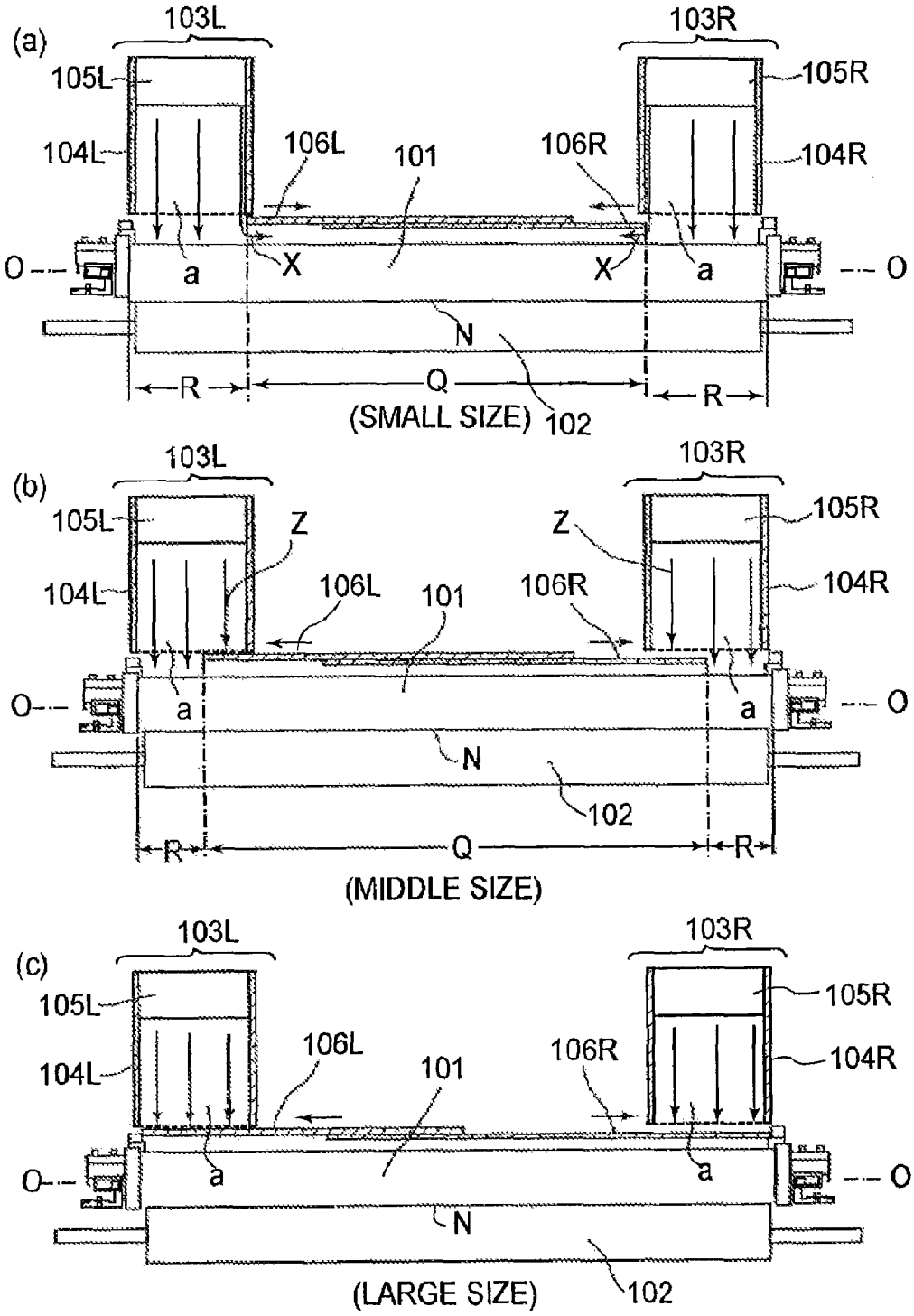
FIG.11 PRIOR ART
FIG. 11 is a schematic drawing of a fixing apparatus in accordance with the prior art.

FIG. 10 is a schematic vertical sectional view of an electrophotographic full-color printer, which is an example of an image forming apparatus, the fixing apparatus of which is an image heating apparatus in accordance with the present invention. It shows the general structure of the image forming apparatus. First, the image forming portion of the apparatus will be briefly described.

This printer can output a full-color image on recording medium, in response to picture information inputted from an external host apparatus 200 connected to the control circuit portion 100 (controlling means: CPU) of the printer so that communication is possible between the printer and external host apparatus 200.

The examples of the external host apparatus 200 are a computer, an image reader, and the like. The control circuit 100 exchanges signals with the external host apparatus 200. Further, the control circuit 100 exchanges signals with various image forming devices, and controls the image formation sequence.

Designated by a referential number 8 is a flexible intermediary transfer belt (which hereafter will be referred to as belt). The belt 8 is stretched between and around a belt backing roller 9 (which backs up belt 8 against secondary transfer roller) and a tension roller 10. As the roller 9 is driven, the belt 8 is rotationally driven at a preset velocity in the counterclockwise direction indicated by an arrow mark. Designated by a referential number 11 is a secondary transfer roller, which is kept pressed against the abovementioned belt backing roller 9 with the presence of the belt 8 between the two rollers 9 and 11. The interface between the belt 8 and secondary transfer roller 11 is the secondary transfer portion.

Designated by alphanumeric referential symbols 1Y, 1M, 1C, and 1Bk are four image forming portions, that is, first, second, third, and fourth image forming portions, respectively, which are on the underside of the belt 11, being juxtaposed in parallel and series, with preset intervals, in the direction parallel to the direction in which the belt 11 is moved. Each image forming portion is an electrophotographic image forming portion which uses an exposing method based on laser. Each image forming portion has an image bearing member 2, more specifically, an electrophotographic photosensitive member in the form of a drum (which hence will be referred to simply as drum, hereafter). The drum 2 is rotationally driven at a preset peripheral velocity in the clockwise direction indicated by an arrow symbol. Each image forming portion also has a primary charging device 3, a developing apparatus 4, a transferring means 5 in the form of a roller (transfer roller), and a drum cleaning apparatus 6, which are in the adjacencies of the peripheral surface of the drum 2. Each transfer roller 5 is inside the loop which the belt 8 forms, and is kept pressed against the corresponding drum 2, with the portion of the belt 8, which is moving through the bottom portion of the abovementioned belt loop, pinched between the transfer roller 5 and drum 2. The interface between each drum 2 and the belt 8 is one of the primary transferring portions.

Designated by a referential number 7 is a laser-based exposing apparatus of each image forming portion, which exposes the peripheral surface of the drum 2 of the image forming portion. The laser-based exposing apparatus is made up of a laser light emitting means, a polygon mirror, a deflection mirror, etc. The laser light emitting means emits a beam of laser light in response to sequential digital electrical picture element signals which reflect picture information given to the exposing apparatus.

The control circuit 100 causes each image forming portion to carry out an image forming operation, in response to picture signals (which are obtained by separating optical image of original into monochromatic images of primary colors) inputted from the external host apparatus 200. That is, yellow, magenta, cyan, and black toner images are formed, with preset timing, on the peripheral surfaces of the rotating drums 2 in the first-fourth image forming portions 1Y, 1M, 1C, and 1Bk, respectively. Incidentally, the principle of the electrophotographic process for forming a toner image on the peripheral surface of the drum 2 is well-known, and therefore, will not be described here.

As the toner images are formed on the peripheral surfaces of the drums 2 in the image forming portions, they are sequentially transferred in layers onto the outward surface of the belt 8, in the primary transferring portions. The belt 8 is circularly driven at a velocity which matches the peripheral velocity of each drum 2, in such a direction that the belt 8 and the peripheral surface of each drum 2 move in the same direction in the primary transferring portion. As a result, an unfixed full-color toner image is synthetically effected by the four toner images layered on the surface of the belt 8.

Meanwhile, the sheet feeder roller 14 of the sheet feeder cassette selected from among the sheet feeder cassettes 13A, 13B, and 13C which are vertically stacked in the sheet feeder cassette chamber, and in which multiple large, medium, and small sheets of papers are stored in layers, respectively, is driven with a preset timing. As the sheet feeder roller 14 is driven, one of the sheets of recording medium P in the selected sheet feeder cassette is separated from the rest, and is conveyed to a pair of registration rollers 16 through a vertical sheet conveyance path 15. When the image forming apparatus is in the manual feeding mode, a sheet feeder roller 18 is driven. As the sheet feeder roller 18 is driven, one of the sheets of recording medium P set in layers in a manual feeder tray 17 (multi-purpose tray) is separated from the rest, and is conveyed to the pair of registration roller 16 through the vertical sheet conveyance path 15.

The registration rollers 16 are rotated to release and convey the recording medium P with such timing that the leading end of the recording medium P reaches the secondary transferring portion at the same time as the leading end of the abovementioned full-color toner image on the circularly moving belt 8 reaches the secondary transferring portion. Thus, as the recording medium P is conveyed through the secondary transferring portion, the four monochromatic toner images on the surface of the belt 8, which make up the single full-color toner image, are transferred together onto the recording medium P on the belt 8, in a manner of being peeled away from the surface of the belt 8. After coming out of the secondary transferring portion, the recording medium P is separated from the belt 8, and is guided into a fixing apparatus 20, by which the abovementioned multiple monochromatic toner images on the recording medium P are fixed to the surface of the recording medium P; the four toner images are mixed, while being melted, and are permanently adhered to the surface of the recording medium P. After coming out of the fixing apparatus 20, the recording medium P is sent out, as a full-color copy, from the main assembly of the image forming apparatus onto a delivery tray 23, by a pair of sheet discharging rollers 22 through a sheet conveyance path 21.

After the separation of the recording medium P from the belt 8 in the secondary transferring portion, the surface of the belt 8 is cleaned by a belt cleaning apparatus 12, that is, the adherent residues, such as toner particles, remaining on the surface of the belt 8 after the secondary transfer, are removed by the belt cleaning apparatus 12. Then, the cleaned portion of the surface of the belt 8 is used for the following round of image formation.

When the image forming apparatus is in the black-and-white print mode, only the fourth image forming portion 1Bk, which is the portion for forming a black toner image, is operated under the control of the control circuit portion 100. When the image forming apparatus is in the two-sided print mode, the recording medium P is conveyed in the direction to be discharged into the delivery tray 23 by the discharge rollers 22 until the trailing end of the recording medium P almost moves past the interface between the pair of discharge rollers 22, after the printing of an image on the recording medium P. Then, immediately before the trailing end of the recording medium P moves past the sheet discharge rollers 22, the rollers 22 are reversed in rotation. Thus, the recording medium P is introduced into a re-feeding path 24. Then, it is conveyed through the re-feeding path 24 to be conveyed again to the registration rollers 16, being thereby placed upside down. Thereafter, the recording medium P is conveyed through the secondary transfer portion and fixing apparatus 20 as it was when an image was printed on the first surface. Then, the recording medium P is sent out as a two-sided copy, onto the delivery tray 23.

(2) Fixing Apparatus 20

In the following description of the fixing apparatus 20, the "lengthwise direction" of the fixing apparatus 20 and the components thereof is synonymous to the direction parallel to the direction perpendicular to the recording medium conveyance direction. The "front side" of the fixing apparatus 20 is synonymous to the lateral side of the fixing apparatus 20, from which the recording medium P is introduced into the fixing apparatus 20, and the "left" or "right" side of the apparatus is synonymous to the left or right side of the apparatus as seen from the front side of the apparatus. The "width" of a sheet of recording medium is synonymous to the measurement of the sheet in terms of the direction perpendicular to the recording medium conveyance direction.

Figure 1:
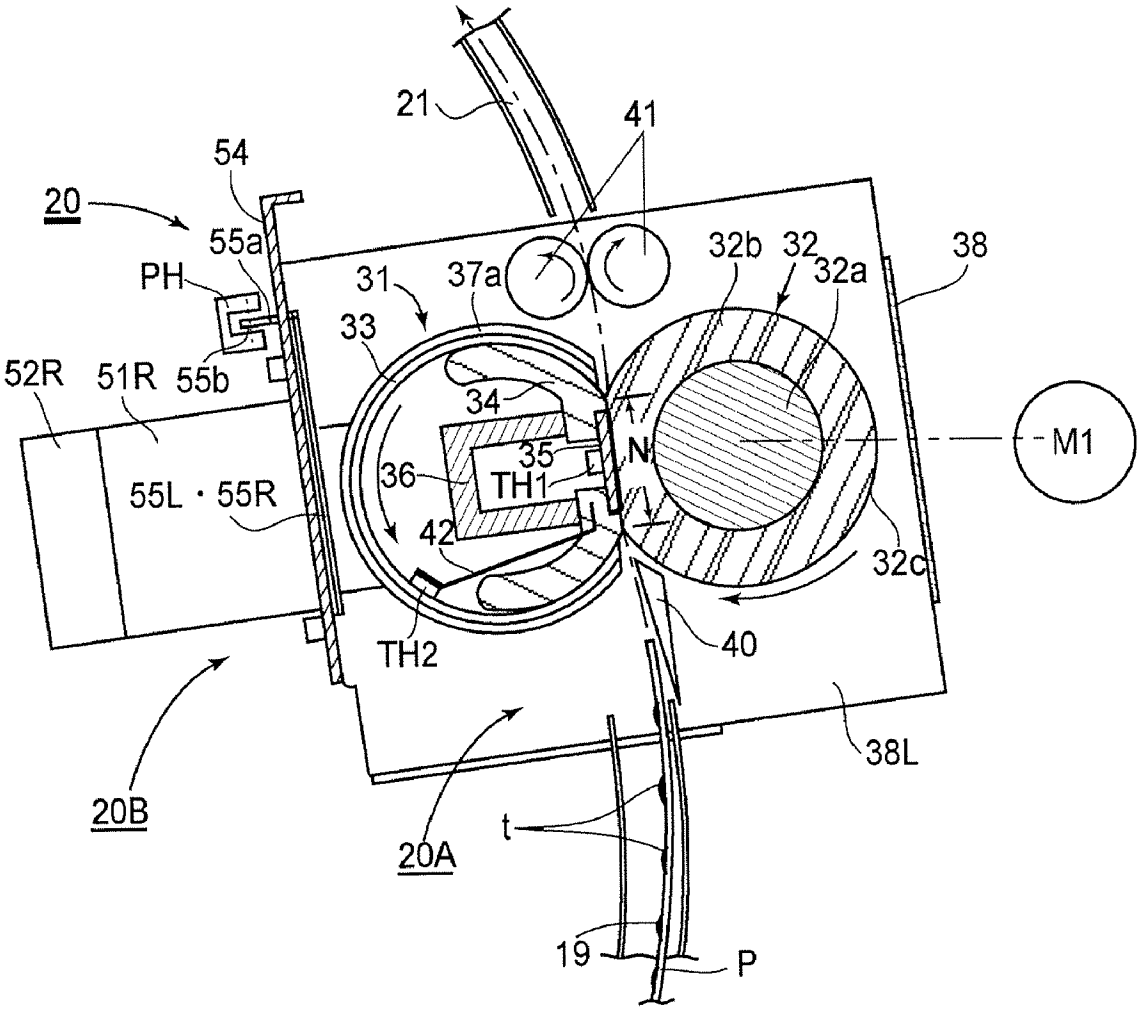
FIG. 1 is a schematic cross-sectional view of the fixing apparatus in the first preferred embodiment of the present invention.

FIG. 1 is an enlarged schematic cross-sectional view of the fixing apparatus 20 of the image forming apparatus shown in FIG. 10. The fixing apparatus 20 is roughly separable into a fixing mechanism portion 20A, and a forced draft cooling mechanism portion 20B. The fixing mechanism portion 20A employs a heating belt. The cooling mechanism portion 20B uses forced draft of air as cooling medium.

(2-1) Fixing Mechanism Portion 20A

Figure 2:
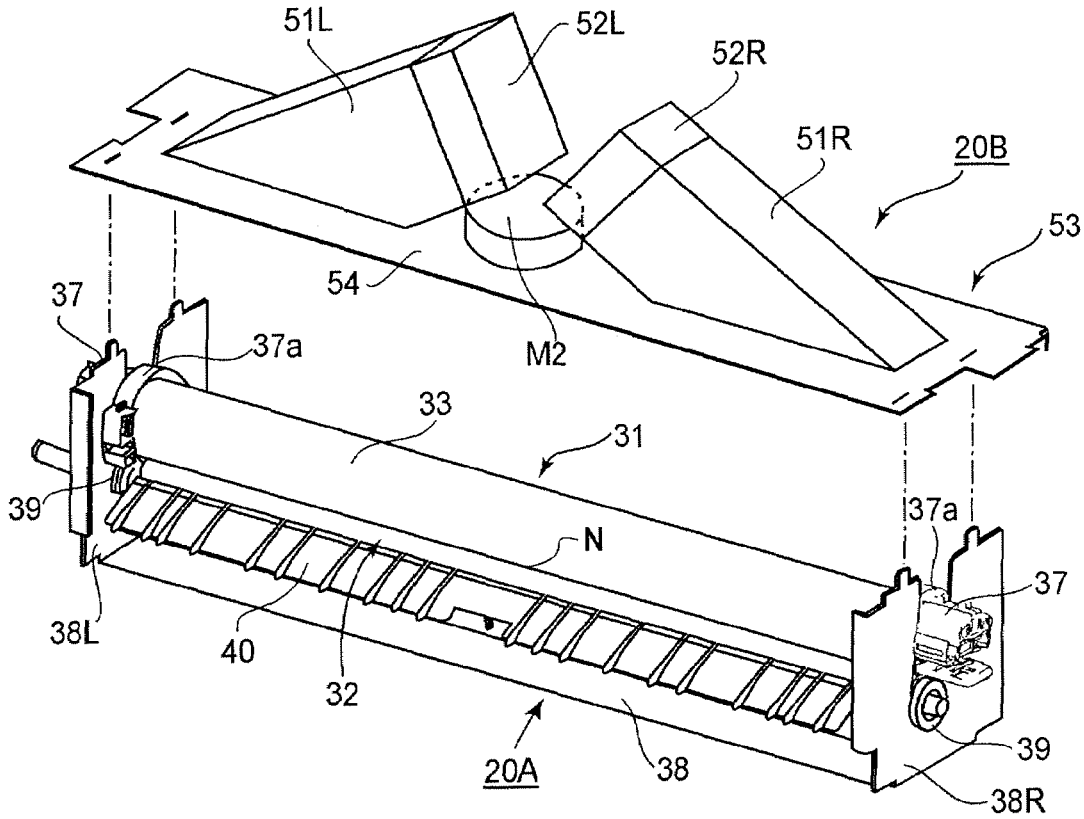
FIG. 2 is a partially exploded schematic perspective view of the fixing mechanism portion and forced draft cooling mechanism portion of the fixing apparatus shown in FIG. 1.
Figure 3:
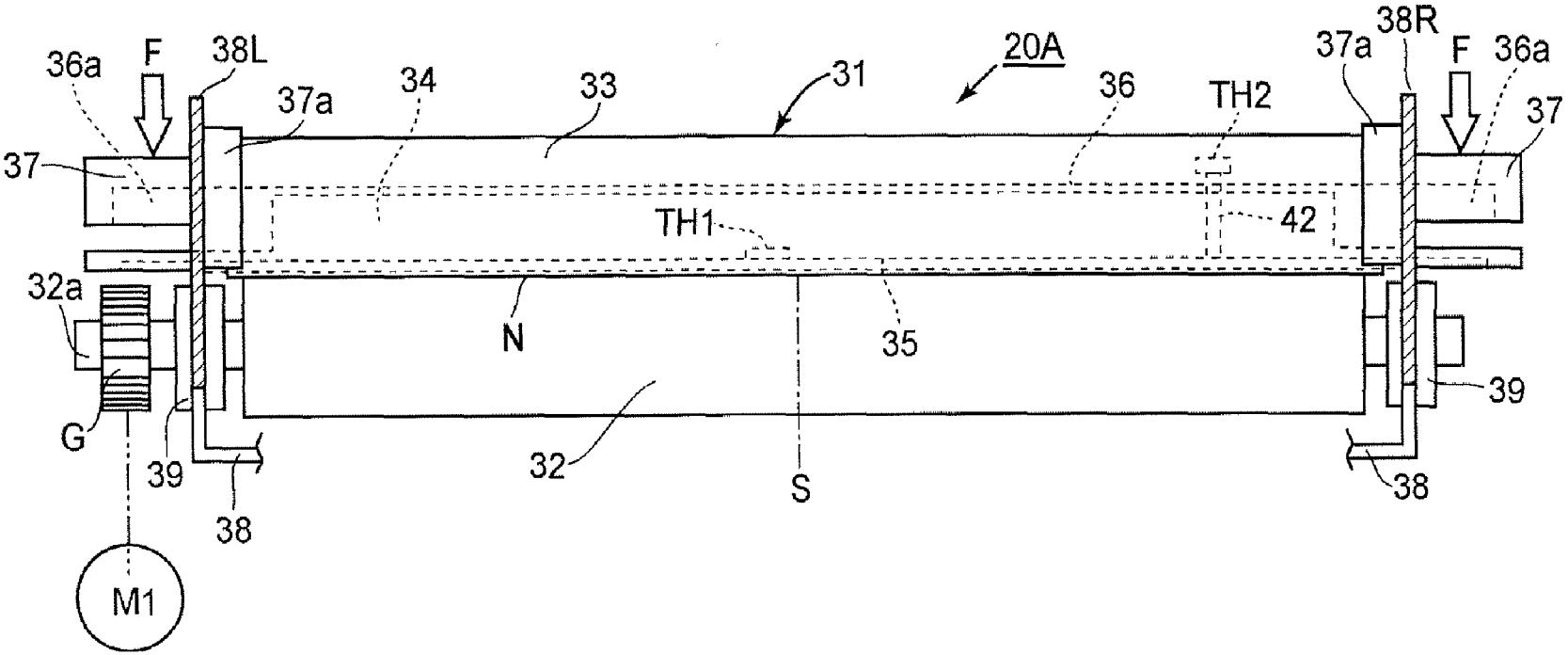
FIG. 3 is a schematic partially cutaway front view of the fixing mechanism portion of the fixing apparatus.
Figure 4:
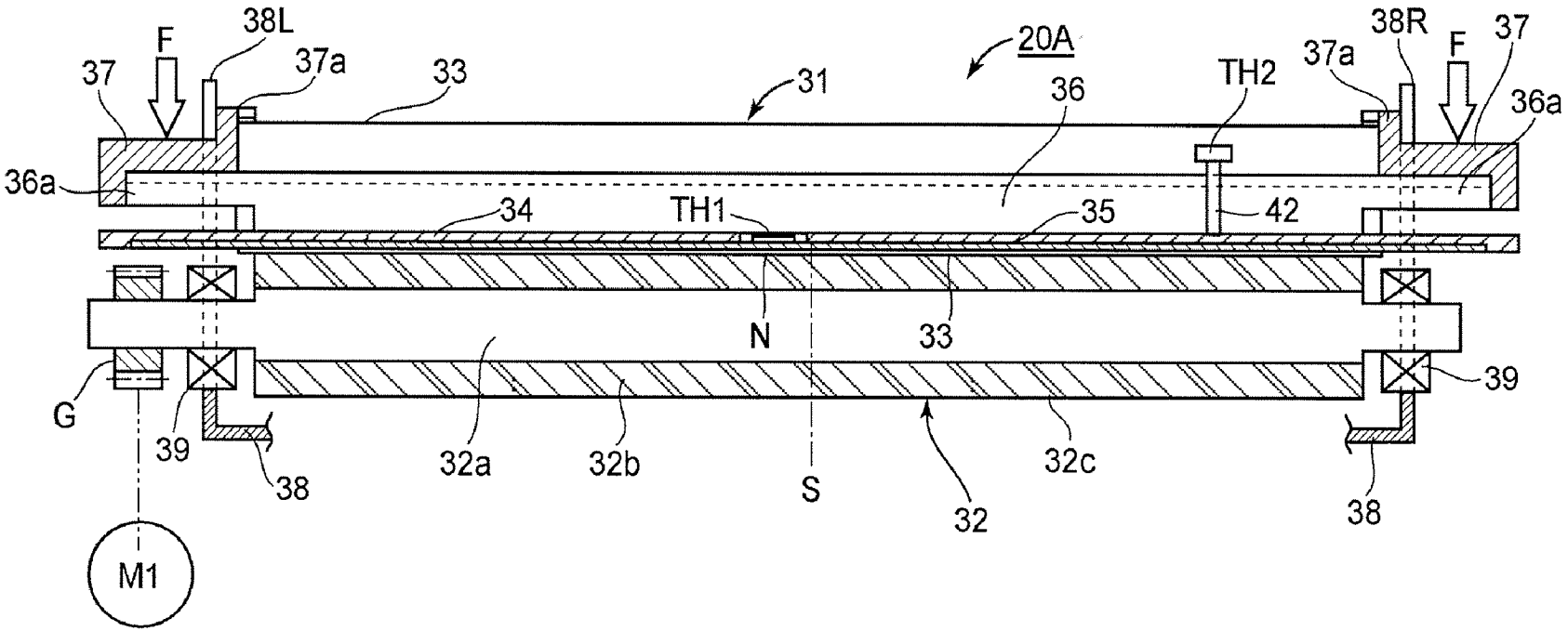
FIG. 4 is a schematic vertical sectional view of the fixing mechanism portion of the fixing apparatus.
Figure 9:
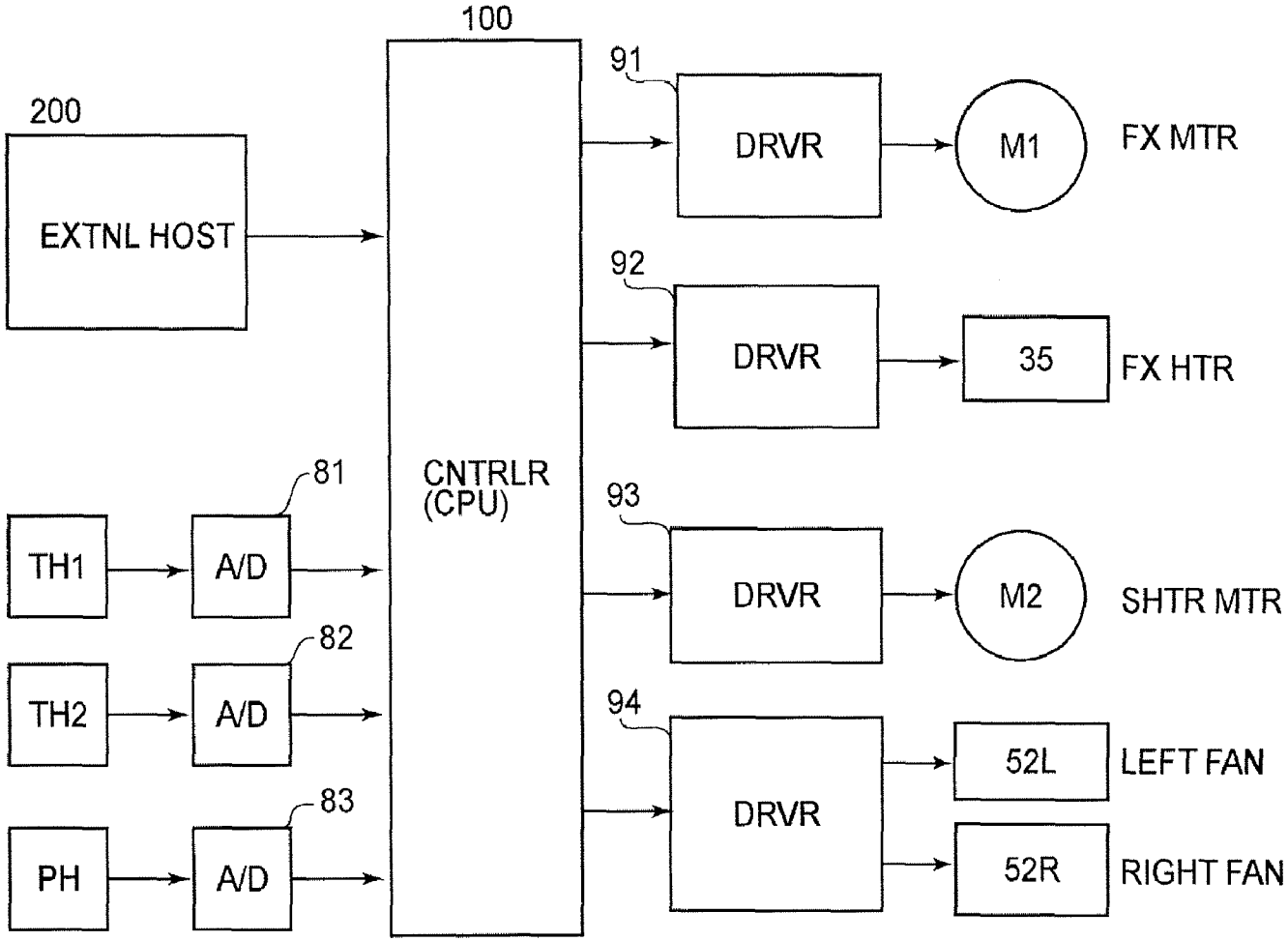
FIG. 9 is a block diagram of the control system of the fixing apparatus.

First, referring to FIGS. 1-4, and 9, the general structure of the fixing mechanism portion 20A will be described. FIG. 2 is an exploded perspective view of the combination of the fixing mechanism portion 20A and forced draft cooling mechanism portion 20B. FIG. 3 is a schematic front view of the combination of the fixation belt assembly and pressure application roller of the fixing mechanism portion 20A. FIG. 4 is a vertical sectional view of the combination of the fixation belt assembly and pressure applying roller (which hereafter will be referred to simply as pressure roller), shown in FIG. 2, at a plane which coincides with the axial line of the pressure roller. FIG. 9 is a block diagram of the control system of the fixing apparatus 20.

Basically, the fixing mechanism portion 20A is identical to the fixing apparatus disclosed in Japanese Laid-open Patent Applications H04-44075-44083, H04-204980-204984, etc. It is a fixing apparatus of the on-demand type, and employs the heating belt (heating film). Further, this fixing apparatus employs a pressure applying rotational member to circularly drive the belt; it is of the tension-less type.

Designated by a referential number 31 is a fixation belt assembly, and designated by a referential number 32 is an elastic pressure roller, which is a pressure applying rotating member. The fixation belt assembly 31 and pressure roller 32 are kept pressed against each other to form a fixation nip N.

Designated by a referential number 33 is a fixation belt of the fixation belt assembly 31, which is a circularly movable member for heat application. The fixation belt 33 is cylindrical; it is endless and in the form of a sleeve. It is flexible. Designated by a referential number 34 is a belt guiding member (which hereafter will be referred to simply as guiding member), which is heat resistant and rigid. The guiding member 34 is in the form of a trough, and is semicircular in cross section. Designated by a referential number 35 is a ceramic heater (which hereafter will be referred to simply as heater) as a heat source (heating member). The guiding member 34 is provided with a groove, which is in the outwardly facing surface of the guiding member 34 and extends in the lengthwise direction of the guiding member 34. The heater 35 is fitted in this groove of the guiding member 34, being thereby solidly attached to the guiding member 34. The fixation belt 33 is loosely fitted around the guiding member 33 fitted with the heater 35. Designated by a referential number 36 is a pressure application stay (which hereafter will be referred to simply as stay). The stay 36 is rigid, and is U-shaped in cross section. It is on the inward side of the guiding member 34. Designated by a pair of alphanumeric referential symbols 36*a* are a pair of arm portions extending outward from the left and right lengthwise ends of the stay 36, one for one. Designated by a pair of referential numbers 37 are a pair of end holders in which the arm portions 36*a* are fitted, one for one. Designated by an alphanumeric symbol 37*a* is a flange portion, which is an integral part of the end holder 37.

Ordinarily, the fixation belt 33 is a laminar belt, and is made up of a base layer, an elastic layer, a release layer, etc. The base layer is formed of heat resistant resin or metal. The fixation belt 33 is thin and flexible. It is high in thermal conductivity, and is low in thermal capacity.

The ceramic heater 35 is a linear heating member. It is low in thermal capacity. It is attached to the guiding member 35 so that it extends in the direction perpendicular to the moving direction of the fixation belt 33 and recording medium P. Basically, it is made up of a substrate and a heat generation layer. The substrate is formed of ceramic, such as aluminum titanate, alumina, or the like. The heat generation layer is formed on the substrate, of silver-palladium, or the like, and generates heat as electric current is flowed through it. There are various ceramic heaters, which are well-known. Thus, the ceramic heater 35 will not be described in detail here.

The pressure roller 32 is made up of a metallic core 32*a*, and an elastic layer 32*b* formed around the metallic core 32*a*, of silicone rubber or the like, to reduce the roller 32 in overall hardness. For the improvement of the surface properties of the pressure roller 32, the peripheral surface of the elastic layer 32*b* may be coated with a fluorinated resin layer 32*c* formed of PTFE, PFA, FEP, or the like. The pressure roller 32 is rotatably supported between the left and right lateral plates 38L and 38R of the apparatus frame 38; the left and right end portions of the metallic core 32*a* are supported by a pair of bearing members 39 with which the left and right lateral plates 38L and 38R are fitted.

The fixation belt assembly 31 is positioned in parallel to the above described pressure roller 32, with the heater side of the fixation belt assembly 31 facing the pressure roller 32. It is kept pressed against the pressure roller 32; the left and right holders 37 are kept pressed with a preset amount of force F generated by an unshown pressure application mechanism, in the direction perpendicular to the axial direction of the pressure roller 32. Thus, the surface of the heater 35 is kept pressed against the pressure roller 32, that is, the elasticity of the elastic layer 32*b* of the pressure roller 32, with the presence of the fixation belt 33 between the heater 35 and pressure roller 32, forming thereby the fixation nip N necessary for thermal fixation. The amount of force F is controlled so that the width of the fixation nip N, in terms of the recording medium conveyance direction, will have a preset value. The pressure application mechanism is provided with a pressure removal mechanism. Thus, when necessary, for example, when dealing with a paper jam or the like, the pressure can be removed to make it easier to remove the jammed recording medium P in the fixation nip N.

Designated by a referential number 40 is an entrance guide attached to the apparatus frame 38, and designated by a referential number 41 is a pair of sheet discharge rollers, which are also attached to the apparatus frame 38. The entrance guide 40 plays the role of guiding the recording medium P so that after the recording medium P is moved past the secondary transfer nip N and is guided into fixing apparatus 20 by the vertical guide 19, it is precisely guided into the fixation nip N.

Designated by a referential letter G is a drive gear solidly attached to one end of the metallic core 32*a* of the pressure roller 32. It is to this gear G that the rotational force of a fixation motor M1 is transmitted through an unshown driving force transmission mechanism. As the driving force is transmitted to the drive gear G, the pressure roller 32 is rotationally driven in the clockwise direction indicated by an arrow mark in FIG. 1. As the pressure roller 32 is rotationally driven, rotational force is transmitted to the fixation belt 33 by the friction between the outward surface of the fixation belt 33 and the pressure roller 32. As a result, the fixation belt 33 rotates in the counterclockwise direction indicated by an arrow mark, with its inward surface remaining in contact with, and sliding on, the heater 35, on the outward side of the guiding member 34 (pressure roller is driven to circularly move fixation belt 33). The fixation belt 33 circularly moves at a peripheral velocity which is roughly equal to the peripheral velocity of the pressure roller 32. The left and right flange portions 37*a* catch the belt 33 by the corresponding lateral edges of the fixation belt 33 as the fixation belt 33 deviates in the left or right direction; they control the lateral movement of the fixation belt 33. The inward surface of the fixation belt 33 is coated with grease (lubricant) to ensure that the fixation belt 33 smoothly slides on the heater 35 and guiding member 34.

After the recording medium P is guided into the fixation nip N, it is conveyed through the fixation nip N by the rotation of the pressure roller 32 and fixation belt 33 while remaining pinched by the pressure roller 32 and fixation belt 33. In this embodiment, the recording medium P is conveyed through the fixation apparatus 20 so that the centerline of the recording medium P in the fixing apparatus 20 coincides with the centerline of the recording medium conveyance passage, in terms of the lengthwise direction of the fixing apparatus (central alignment). That is, as the recording medium P is guided into the fixing apparatus 20, it is conveyed through the fixing apparatus 20 so that the centerline of the recording medium P coincides with the centerline of the recording medium passage, regardless of the size of the recording medium conveyable through the fixing apparatus 20. Designated by a referential letter S is the referential centerline (theoretical line) of the recording medium passage of the fixing apparatus 20, which coincides with the centerline of the recording medium P when the recording medium P is conveyed through the fixing apparatus 20.

Designated by alphanumeric referential symbols TH1 and TH2 are main and subordinate thermistors as first and second temperature detecting means, respectively. In terms of the lengthwise direction of the heater 35, the main thermistor TH1 is placed in contact with the roughly the center of the rear surface of the heater 35 to detect the temperature of the portion of the heater which remains within the recording medium path regardless of recording medium size. The subordinate thermistor TH2 is placed elastically in contact with the inward surface of the fixation belt 33 to detect the temperature of the portion of the fixation belt 33 which corresponds to the portion of the recording medium passage, which is outside the path of a recording medium narrower than the path of a widest recording medium conveyable through the fixing apparatus 20. More concretely, the subordinate thermistor TH2 is supported by the free end portion of an elastic thermistor supporting member 42, which is in the form of a leaf spring. The supporting member 42 is fixed to the guiding member 34. In other words, the subordinate thermistor TH2 is kept elastically in contact with the inward surface of the fixation belt 33 by the elasticity of the elastic thermistor supporting member 42.

As electric current is flowed by a heater driver circuit 92 (FIG. 9), as an electric power supplying portion, through the heat generation layer of the heater 35, which is on the heater substrate, the heat generation layer generates heat. As a result, the heater 35 quickly increases in temperature across the entirety of its effective heat generation range in terms of its lengthwise direction. The temperature of the heater 35 is detected by the main thermistor TH1, and the electrical information regarding this heater temperature is inputted into the control circuit portion 100 through an A/D converter 81. In addition, the temperature of the fixation belt 33 is detected by the subordinate thermistor TH2, and the electrical information regarding this temperature of the fixation belt 33 is inputted into the control circuit portion 100 through an A/D converter 82. The control circuit portion 100 sets up a proper procedure for adjusting the temperature of the fixation heater 35 based on the outputs of the main and subordinate thermistors TH1 and TH2, in order to control the amount of electric power supplied to the fixation heater 35 from the heater driver circuit 92. That is, the temperature of the fixation heater 35 is controlled so that the heater temperature detected by the main thermistor TH1 remains at a preset fixation temperature level.

The control circuit portion 100 starts to rotationally drive the pressure roller 32 by controlling the fixation motor driver circuit 91 in response to a print start signal from the external host apparatus 200, or a control signal other than the print start signal. The control circuit portion 100 also starts to generate heat in the heater 35 by controlling the heater driver circuit 92. As soon as the fixation belt 33 stabilizes in circulatory speed, and the temperature of the heater 35 reaches the preset level, the recording medium P bearing an unfixed toner image t is guided into the fixation nip portion N along the entrance guide 40 from the direction of the image forming portion, with the toner image bearing surface of the recording medium P facing the fixing belt 33. The recording medium P, and the portion of the fixation belt 33, which corresponds to the recording medium P, move together through the fixation nip N, with the recording medium P kept pressed against the heater 35, with the presence of the fixation belt 33 between the heater 35 and recording medium P. While the recording medium P is conveyed through the fixation nip N, the recording medium P is given heat by the fixation belt 33 heated by the heater 35. As a result, the toner image t on the recording medium P is thermally fixed to the surface of the recording medium P. After the conveyance of the recording medium P through the fixation nip N, the recording medium P is separated from the surface of the fixation belt 33, and is conveyed further to be discharged from the apparatus main assembly.

(2-2) Forced Draft Cooling Mechanism Portion 20B

Figure 5:
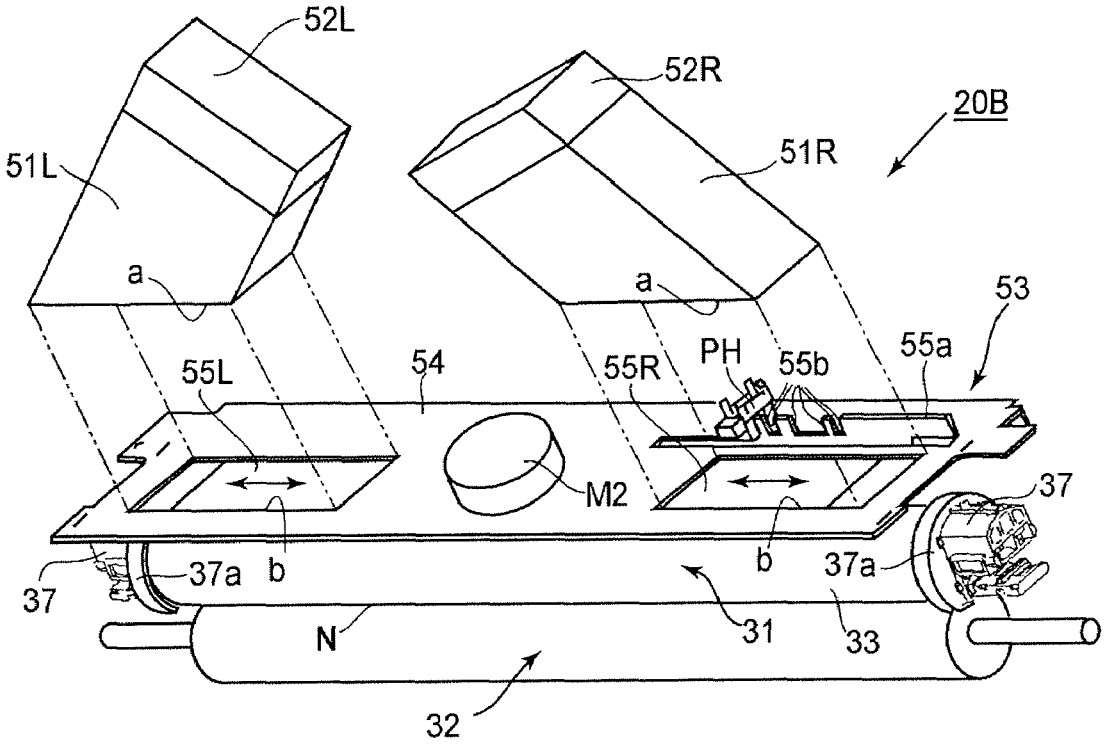
FIG. 5 is a schematic exploded perspective view of the forced draft cooling mechanism portion of the fixing apparatus.
Figure 6:
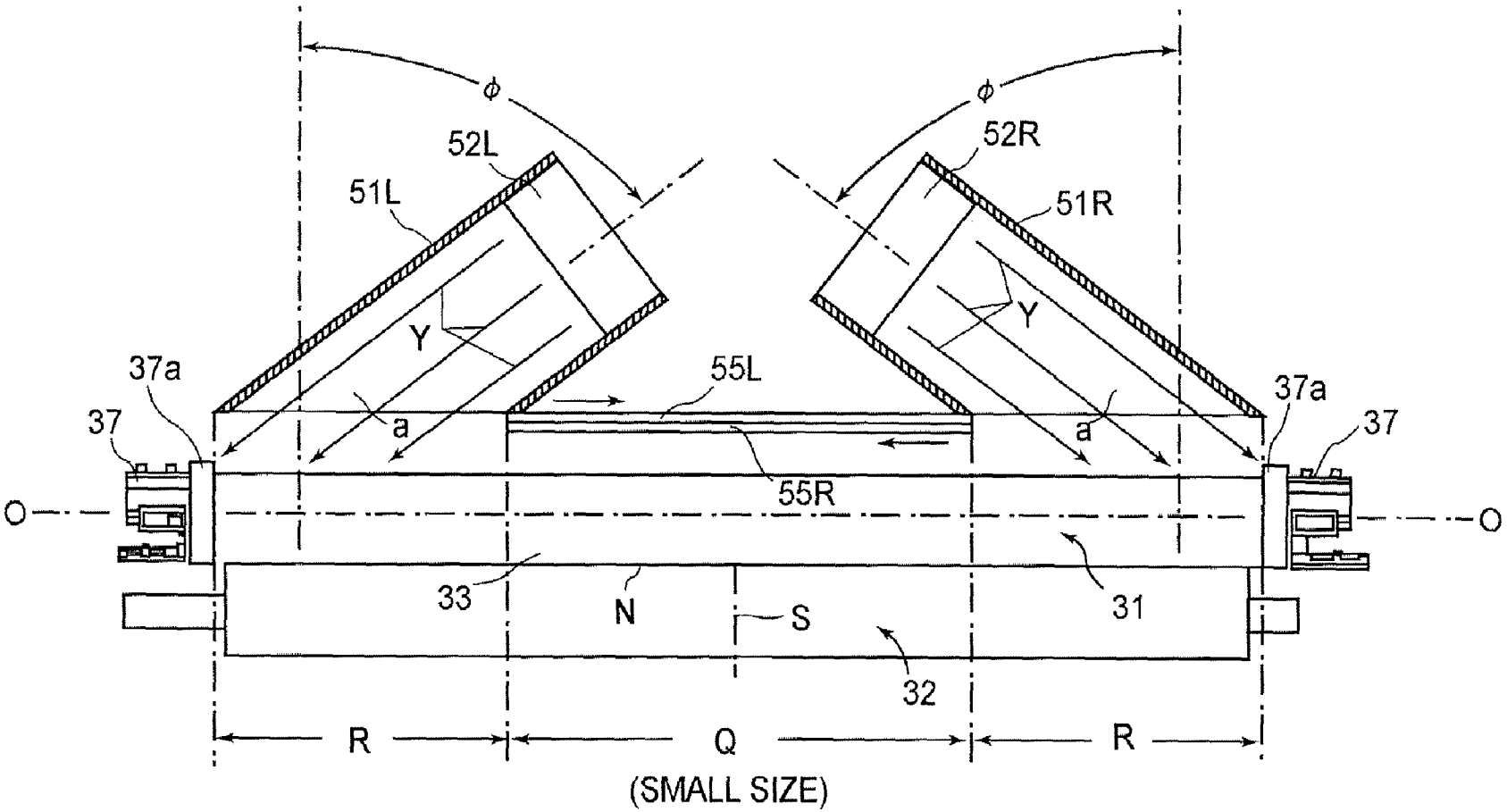
FIG. 6 is a schematic vertical sectional view of the fixing apparatus, through which a substantial number of small sheets of recording medium are being continuously conveyed.
Figure 7:
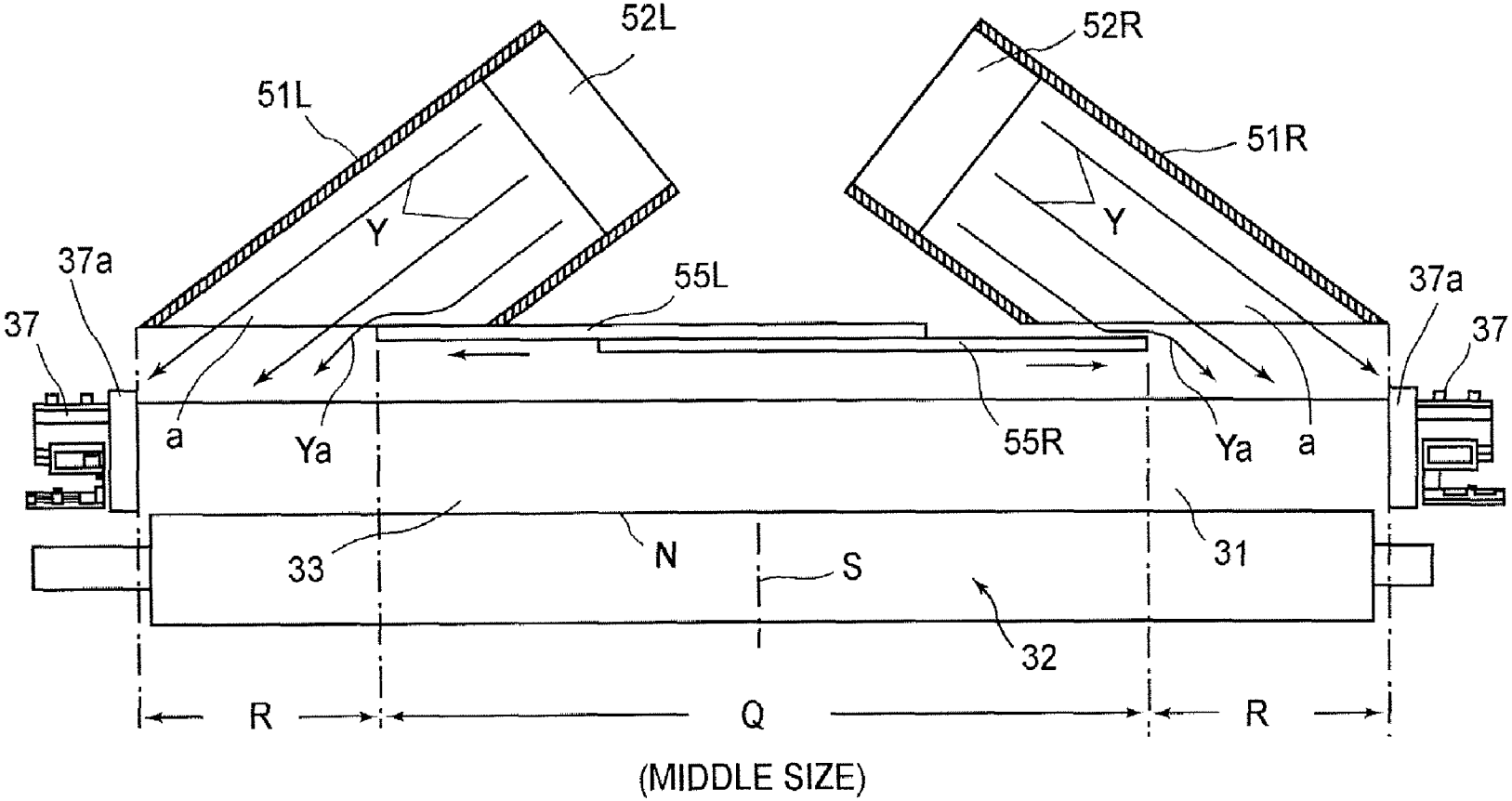
FIG. 7 is a schematic vertical sectional view of the fixing apparatus, through which a substantial number of medium sheets of recording medium are being continuously conveyed.
Figure 8:
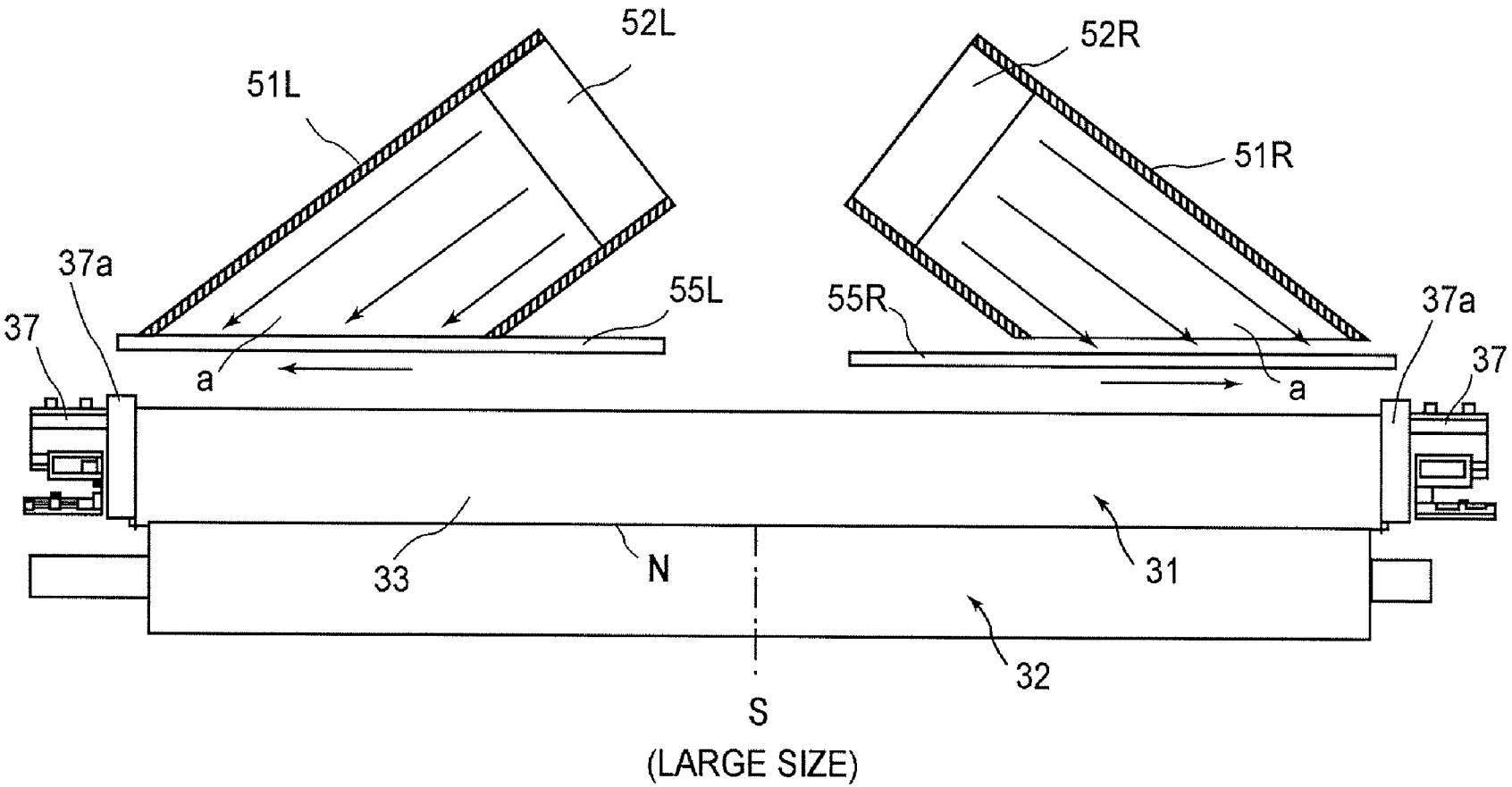
FIG. 8 is a schematic vertical sectional view of the fixing apparatus, through which a substantial number of large sheets of recording medium are being continuously conveyed.

Next, referring primarily to FIGS. 5-8, the forced draft cooling mechanism portion 20B will be described. The forced draft cooling mechanism portion 20B is a cooling means which cools the fixing mechanism portion 20A by sending air thereto. More specifically, as a recording medium, which is narrower than a widest recording medium, is continuously conveyed through the fixing apparatus 20, the portions of the fixing mechanism portion 20A, which are outside the path of the narrower recording medium, are likely to increase in temperature. It is this increase in temperature of the portions of the fixing mechanism portion 20A, which hereafter will be referred to as out-of-sheet-path temperature increase, that the forced draft cooling mechanism 20B prevents by sending air thereto. FIG. 5 is an exploded perspective view of the forced draft cooling mechanism portion 20B. FIGS. 6-8 are schematic drawings of the forced draft cooling mechanism portion 20B, showing the operation of the shutter plates.

The forced draft cooling mechanism portion 20B is provided with a left duct 51L and a left cooling fan 52L. The left duct 51L is structured so that its air outlet a faces the left end portion of the fixation belt 33 in terms of the lengthwise direction of the fixation belt 33. The left cooling fan 52L sends the cooling draft into the left duct 51L. The forced draft cooling mechanism portion 20B is also provided with a right duct 51R and a right cooling fan 52R. The right duct 51R is structured so that its air outlet a faces the right end portion of the fixation belt 33 in terms of the lengthwise direction of the fixation belt 33. The right cooling fan 52R sends the cooling draft into the right duct 51R. Further, the forced draft cooling mechanism 20A is provided with a shutter mechanism 53, as an air outlet opening width adjusting means, for adjusting the left and right ducts 51L and 51R in the width of the openings of their air outlets a.

As the cooling fans 51L and 51R, a pair of axial flow fans are employed, which are lower in cost than a sirocco fan and a cross-flow fan.

The shutter mechanism 53 has a shutter frame 54, left and right shutter plates 55L and 55R, a shutter motor M2, shutter plate position detecting means 55*a*, 55*b*, PH, etc. The shutter frame 54 is provided with left and right holes b and b (windows). The left and right holes b and b of the shutter frame 54 correspond in shape and size to the air outlets a and a of the left and right ducts 51L and 51R, respectively. The left and right ducts 51L and 51R are fixed to a substrate (shutter frame) 54 so that the air outlets a and a of the left and right ducts 51L and 51R align with the left and right holes b and b of the substrate 54 (shutter frame).

The pair of shutters, that is, the left and right shutter plates 55L and 55L, are located on the opposite side of the substrate 54 (shutter frame) from the side to which the ducts 51L and 51R are fixed. The left shutter plate 55L is movable to adjust the width of the left hole b of the substrate 54 (shutter frame), that is, the width of the opening of the air outlet a of the left duct 51L, whereas the right shutter plate 55R is movable to adjust the width of the right hole b of the substrate 54, that is, the width of the opening of the air outlet a of the right duct 51R. The left and right shutter plates 55L and 55R are connected to each other with an unshown rack-and-pinion mechanism. Thus, as the pinion is rotationally driven forward or in reverse by the shutter motor M2 (pulse motor), the left and right shutter plates 55L and 55R connected to the rack are moved to increase or reduce the width of the openings of the air outlets a and a of the left and right ducts 51L and 51R, respectively, while keeping the two openings equal in width.

For clarity, FIGS. 6-8 show only the left and right ducts 51L and 51R, left and right cooling fans 52L and 52R, and left and right shutter plates 55L and 55R, of the forced draft cooling mechanism portion 20B.

The left and right ducts 51L and 51R are tilted so that their center lines align with the approximate rotational axis O-O of the fixation belt 33, and also, so that the draft inlet sides of the left and right ducts 51L and 51R are on the inward side of the fixing mechanism portion 20A, in terms of the lengthwise direction of the fixation roller, relative to the outlet sides of the left and right ducts 51L and 51R, respectively. Therefore, the left and right cooling fans 52L and 52R send cooling draft toward the corresponding lateral edges of the fixation belt. That is, the forced draft cooling mechanism portion 20B is structured so that the rotational axes of the cooling fans 52L and 52R (axial flow fans) are tilted relative to the rotational axis O-O of the fixation belt 33. In other words, the forced draft cooling mechanism portion 20B is structured so that a plane (plane Q in FIG. 6) perpendicular to the direction of the forced draft is tilted relative to the rotational axis O-O of the fixation belt 33.

A referential letter Y designates the flow line of the cooling draft sent into the ducts 51L and 51R by the cooling fans 52L and 52R, respectively. Incidentally, of the three lines designated by the referential letter Y in FIG. 6, the central line Y corresponds to the rotational axis of the fooling fan 52. Further, the ducts 51L and 51R are tilted in parallel to the direction of the cooling draft generated by the cooling fans 52L and 52R, that is, the flow lines Y of the cooling draft, so that the ducts 51L and 51R guide the cooling draft toward the edge portions of the recording medium passage. The forced draft cooling mechanism portion 20B is structured so that the angle $\phi$ (FIG. 6) between the direction of the rotational axes of the cooling fans 52L and 52R (and/or direction in which ducts 51L and 51R extend), and the direction perpendicular to the rotational axis of the fixation belt 33 O-O, falls in a range of 10°-80°.

Incidentally, the range 10°-80° was selected for this embodiment through experiments. If the angle $\phi$ is no more than 10°, a substantial amount of cooling draft is lost, and therefore, the out-of-sheet-path portions of the fixation belt assembly 31 cannot be sufficiently cooled. In the case of a forced draft cooling mechanism provided with shutter plates, the cooling draft roughly perpendicularly hit the inward surface of the shutter plate, and therefore, a substantial amount of cooling draft is lost by being blocked by the shutter plate. On the other hand, if the angle $\phi$ is no less than 80°, the cooling draft is ineffective as cooling medium, allowing the out-of-sheet-path portions of the fixing mechanism portion 20A to excessively increase in temperature.

That is, in this embodiment, the cooling means is structured so that the flow lines Y of the cooling draft blown toward the fixation belt 33 from the cooling means 51 and 52 for cooling the out-of-sheet-path portions of the fixation belt 33, which is a heat applying rotational member, by blowing cooling draft toward the out-of-sheet-path portions, are tilted relative to the direction perpendicular to the rotational axis O-O of the fixation belt 33.

More concretely, as described above, the cooling fan 52 is positioned so that the flow lines Y of the cooling draft sent into the duct 51 by the cooling fan 52 are tilted relative to the direction perpendicular to the rotational axis O-O of the fixation belt 33; the duct 51 is positioned so that the axial line of the duct 51 is tilted relative to the direction perpendicular to the rotational axis O-O of the fixation belt 33; the cooling fan 52 is positioned so that the flow lines Y of the cooling draft sent to the duct 51 by the cooling fan 52 are tilted relative to the direction perpendicular to the rotational axis O-O of the fixation belt 33, in such a manner that the upstream ends of the flow lines Y in terms of the direction of the cooling draft, are positioned higher than the downstream ends of the flow lines Y; or the duct 51 is positioned so that the axial line of the duct 51 is tilted relative to the direction perpendicular to the rotational axis O-O of the fixation roller 33, in such a manner that the upstream side of the axial line of the duct 51 in terms of the direction of the cooling draft is positioned higher than the downstream side of the axial line of the duct 51.

Regarding the size of the sheet recording medium conveyable through the fixing apparatus 20, hereafter, a sheet of recording medium which is the largest in width will be referred to as the large recording paper, and a sheet of recording medium which is the smallest in width will be referred to as the small recording paper. Further, a sheet of recording medium whose width is between the width of the small recording paper that the width of the large recording paper, will be referred to as the medium recording paper.

FIG. 6 is a schematic drawing of the fixing mechanism portion 20A in the state in which a small recording paper is being conveyed through the fixing apparatus 20. In FIG. 6, designated by a referential letter Q is the path of a small recording paper, and designated by a referential letter R are the left and right out-of-sheet-path portions of the recording medium passage of the fixing apparatus 20, which are on the left and right sides of the path Q, or the path of a small recording paper. The air outlets a and a of the left and right ducts 51L and 51R correspond to the left and right out-of-sheet-path portions R and R. The width of the openings of the air outlets a and a of the left and right ducts 51L and 51R are the same as those of the left and right out-of-sheet-path portion R and R, respectively. Further, when the fixing mechanism portion 20A is in the state shown in FIG. 6, the left and right shutter plates 55L and 55R are in the position in which they leave fully open the air outlets a of the left and right ducts 51L and 51R. Thus, the left and right end portions of the fixation belt 33, which correspond to the left and right out-of-sheet-path portions R and R, that is, the portions of the recording medium passage, which occur when a small recording paper is conveyed through the fixing apparatus 20, are cooled by the cooling draft blown onto them through the air outlets a and a of the left and right ducts 51L and 51R, which are fully open. Therefore, the problem that the portions of the fixation belt 33, which correspond to the out-of-sheet-path portions of the sheet conveyance passage, which occur when a small recording paper is conveyed through the fixing apparatus, increase in temperature when a substantial number of small sheets of recording paper are continuously conveyed through the fixing apparatus, is prevented.

FIG. 7 is a schematic drawing of the fixing mechanism portion 20A in the state in which a medium recording paper is being conveyed through the fixing apparatus 20. In FIG. 7, designated by a referential letter Q is the path of a medium recording paper, and designated by a referential letter R are the left and right out-of-sheet-path portions of the recording medium passage of the fixing apparatus 20, which are on the left and right sides of the path Q, or the path of a medium recording paper. When medium sheets of recording medium are used as recording medium, the left and right shutter plates 55L and 55R are moved to the positions which were set in accordance with the width of a medium recording paper to reduce the width of the air outlets a and a of the ducts 51L and 51R to the values equal to the widths of the left and right out-of-sheet-path portions R and R which occur as a medium recording paper is conveyed. Thus, the portions of the fixation belt 33, which correspond to the left and right out-of-sheet-path portions R and R, that is, the portions of the recording medium passage, which occur when a medium recording paper is conveyed through the fixing apparatus 20, are cooled by the cooling draft blown onto them through the air outlets a and a of the left and right ducts 51L and 51R, which have been adjusted in width. Therefore, the problem that the portions of the fixation belt 33, which correspond to the out-of-sheet-path portions, which occur when a medium recording paper is conveyed through the fixing apparatus, increase in temperature when a substantial number of medium sheets of recording paper are continuously conveyed through the fixing apparatus, is prevented.

FIG. 8 is a schematic drawing of the fixing mechanism portion 20A in the state in which a large recording paper is being conveyed through the fixing apparatus 20. When the fixing mechanism portion 20A is in the state shown in FIG. 8, the out-of-sheet-path portion does not occur, and therefore, the problem that the portions of the fixation belt 33, which correspond to the out-of-sheet-path portions, increase in temperature does not occur. Therefore, the left and right shutter plates 55L and 55R are moved into the position in which they keep completely blocked the air outlets a and a of the left and right ducts 51L and 51R. Thus, the fixation belt 33 is not cooled by the cooling draft. Incidentally, in this case, that is, when sheets of large recording medium are conveyed through the fixing apparatus 20, the fixing mechanism portion 20A may be controlled so that the cooling fans 52L and 52R are kept stationary. If the cooling fans 52L and 52R are kept stationary, the control for moving the left and right shutter plates 55L and 55R into the position in which they keep completely blocked the air outlets a and a of the left and right ducts 51L and 51R does not need to be executed.

The left and right shutter plates 55L and 55R are controlled so that they move to the positions which correspond to the width of the recording medium used for image formation. Thus, the width of the air outlets a and a of the left and right ducts 51L and 51R is adjusted to the optimum width, that is, the width matching the width of the sheet of recording medium used for the ongoing image forming operation. Therefore, the fixation belt 8 is optimally cooled by the forced draft cooling mechanism portion 20B; the fixation belt 8 is cooled by the forced draft cooling mechanism 20A, with its air outlets matching in width the sheet of recording medium in use. More concretely, of the left and right shutter plates 55L and 55R, the right shutter plate 55R is provided with a rib 55*a* (FIGS. 1 and 5), which is formed by cutting and bending a small portion of the shutter frame 54. The rib 55*a* is provided with multiple smaller ribs 55*b*, the position of which is set according to the various recording medium widths. Further, the shutter frame 54 is provided with a photosensor PH for detecting the smaller ribs 55*b*. The photosensor PH is solidly fixed to the shutter frame 54. The information regarding the detection of the small ribs 55*b* by the photosensor PH is inputted into the control circuit portion 100 through an A/D converter 83. The control circuit portion 100 rotates the shutter motor M2 forward or in reverse, moving the left and right shutter plates 55L and 55R, so that one of the small ribs 55*b*, which matches the information regarding the recording medium size, which is inputted from the external host apparatus 200 or the like, is detected by the photosensor PH. Then, as the small rib 55*b*, which matches the information regarding the width of the recording medium in use, is detected, the driving of the shutter motor M2 is stopped. As a result, the left and right shutter plates 55L and 55R are stopped at the positions, one for one, which correspond to the width of the recording medium in use.

Next, the operation of the left and right cooling fans 52L and 52R of the fixing apparatus 20 in this preferred embodiment will be described. As a substantial number of small or medium recording papers, that is, recording papers smaller than a large recording paper, are continuously conveyed for fixation through the fixing apparatus during an image forming operation, the portions of the fixation belt 33, which correspond to the out-of-sheet-path portions R and R (FIGS. 6 and 7), increases in temperature. The subordinate thermistor TH2, as the second temperature detecting means, detects the temperature of the portion of the inward surface of the fixation belt 33, which corresponds to one of the out-of-sheet-path portions. The control circuit portion 100 (controller) checks whether or not the temperature detected by the subordinate thermistor TH2 has reached a preset level. As soon as it determines that the temperature has reached the preset level, it controls the shutter motor driver circuit 93 to move the shutter plates 55L and 55R to the positions which correspond to the width of the recording medium in use, by the shutter motor M2. In addition, the control circuit portion 100 (controller) controls the cooling fan driver circuit 94 (FIG. 9) to start the left and right cooling fans 52L and 52R. As a result, the portions of the fixation belt 33, which correspond to the out-of-sheet-path portions R and R are prevented from excessively increasing in temperature. Then, as the temperature detected by the subordinate thermistor TH2 falls to a preset level because of the cooling of the out-of-sheet-path portions by the cooling draft generated by the cooling fans, the control circuit portion 100 stops the cooling fans 52L and 52R.

The forced draft cooling mechanism portion 20B is controlled so that the level of the temperature detected by the subordinate thermistor TH2, at which the cooling fans 52L and 52R are turned on, and the level of the temperature detected by the subordinate thermistor TH2, at which the cooling fans 52L and 52R are turned off, are changed according to the condition under which the cooling fans operate.

The temperature range in which the cooling fans 52L and 52R are turned on or off in this embodiment is as follows: For example, in an image forming operation in which 100 sheets of recording paper of a size B4 (medium recording papers) are continuously conveyed through the fixing apparatus 20, the operation is controlled in the following manner. That is, while the first-30th sheets of recording paper are conveyed, the cooling fans 52L and 52R are started as the temperature detected by the subordinate thermistor TH2 reaches 200° C., whereas they are stopped as the temperature detected by the subordinate thermistor TH2 falls to 190° C. While the 31st-60th sheets of recording paper are conveyed, the cooling fans 52L and 52R are started as the temperature detected by the subordinate thermistor TH2 reaches 205° C., whereas they are stopped as the temperature detected by the subordinate thermistor TH2 falls to 195° C. For the 61st sheet of recording medium and thereafter, the temperature level at which the cooling fans are started, and the temperature level at which they are stopped, are raised by 5° C. for every 30th sheet of recording paper.

The cooling fans 52L and 52R, and ducts 51L and 51R, are tilted so that the cooling draft is sent from the center line side of the recording medium passage of the fixing apparatus toward the lateral edge portions of the recording medium passage. Therefore, not only is the forced draft cooling mechanism portion 20B in this embodiment is smaller in the spaces which the cooling fans 52L and 52R, and ducts 51L and 51R, occupy, but also, it is wider in the range of each of the out-of-sheet-path portions, which it can cool. In addition, it is structured so that the axial lines of the ducts 51L and 51R are parallel to the flow lines Y of the cooling drafts generated by the cooling fans 52L and 52R, respectively. Therefore, it is very small in the amount of the cooling draft loss.

Further, the forced draft cooling mechanism portion 20B is structured so that the flow lines Y of the cooling draft are tilted in such a manner that the upstream side of the flow lines Y, in terms of the draft flow direction, is higher than the downstream side of the flow lines Y. Therefore, as the cooling draft hits the fixation belt 33, it flows toward the corresponding lateral edge of the fixation belt 33, and therefore, does not divert into the lateral edge portion of the recording medium path range Q. Therefore, the image forming apparatus in this embodiment does not yield a defective image, the defects of which are attributable to the unwanted decrease in the temperature of the portions of the fixing mechanism portions 20A, which are within the recording medium path range Q. Further, the cooling draft hits the inward surface of the shutter plate at an angle. Therefore, even when the shutter plates 55L and 55R are positioned as shown in FIG. 7, the cooling draft flows along the inward surfaces of the shutter plates 55L and 55R as indicated by a flow line Ya. Therefore, the forced draft cooling mechanism portion 20B is significantly smaller in the amount of the cooling draft loss than a forced draft cooling mechanism portion in accordance with the prior art.

Further, the cooling draft is guided toward the lateral edge portions of the fixing mechanism portions. Therefore, the bearing portions, that is, the flange portions 37*a*, which are farther from the recording medium path range Q than the out-of-sheet-path range R, are efficiently cooled. Therefore, a substance which is relatively low in heat resistance temperature, being therefore lower in cost, can be used as the material for the flange portions 37*a*.

1) The application of the present invention is not limited to a fixing mechanism, such as the fixing mechanism portion 20A, in which an unfixed image is fixed by a heated fixation belt, and the fixation belt is driven by driving a rotational pressure applying member. That is, the present invention is also effectively applicable to various types of a fixing mechanism portion other than the above described ones, for example, a fixing mechanism portion of the heat roller type, a fixing mechanism portion employing a heating method based on electromagnetic induction, etc.

2) The present invention is also applicable to an image heating mechanism portion structured so that the positional relationship between recording medium and the image heating mechanism portion, in terms of the direction perpendicular to the recording medium conveyance direction, is controlled by placing one of the lateral edges of the recording medium in contact with the referential member with which the image heating mechanism portion is provided, just as effectively as it is to the image heating mechanism portion described above.

3) Not only is an image heating apparatus in accordance with the present invention usable as a fixing apparatus such as those described above, but also, as a glossiness increasing apparatus, or the like, for heating a fixed image on recording medium in order to increase the image in glossiness.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 232080/2006 filed Aug. 29, 2006, which is hereby incorporated by reference.

What is claimed is:

1. An image heating apparatus comprising:

a heating rotatable member for heating a toner image on a recording material at a nip;

an axial flow fan for cooling said heating rotatable member at a longitudinal end portion thereof, and a duct, extending along an axis of said axial flow fan, for guiding air flow provided by said axial flow fan toward said heating rotatable member;

wherein the axis of said axial flow fan extends from an outlet of said duct disposed adjacent the longitudinal end portion at an incline toward a longitudinally central portion of said heating rotatable member.

2. An apparatus according to claim 1, wherein the axis of said axial flow fan and a rotational axis of said heating rotatable member form an angle of not less than 10° and not more than 80°.

3. An image heating apparatus comprising:

a heating rotatable member for heating a toner image on a recording material at a nip;

an axial flow fan for cooling said heating rotatable member at a longitudinal end portion thereof by blowing cooling air thereon;

wherein a rotational axis of said axial flow fan is directed with longitudinal outward inclination relative to a rotational axis of said heating rotatable member toward a longitudinal end portion of said heating rotatable member.

4. An apparatus according to claim 3, wherein the rotational axis of said axial flow fan and the rotational axis of said heating rotatable member form an angle of not less than 10° and not more than 80°.

5. An apparatus according to claim 3, further comprising a duct, extending along the rotational axis of said axial flow fan, for guiding air flow provided by said axial flow fan toward said heating rotatable member.

* * * * *